US006337704B1

(12) United States Patent
Yamaguchi

(10) Patent No.: US 6,337,704 B1
(45) Date of Patent: Jan. 8, 2002

(54) THERMAL HEAD ADJUSTING METHOD

(75) Inventor: Akira Yamaguchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/059,415

(22) Filed: Apr. 14, 1998

(30) Foreign Application Priority Data

Apr. 14, 1997 (JP) ..... 9-095807

(51) Int. Cl.[7] ..... B41J 2/36
(52) U.S. Cl. ..... 347/191; 347/188
(58) Field of Search ..... 347/203, 188, 347/191; 400/120.09, 120.11

(56) References Cited

U.S. PATENT DOCUMENTS 4,573,058 A * 2/1986 Brooks ..... 347/191
5,324,121 A 6/1994 Sasaki et al. ..... 347/202

FOREIGN PATENT DOCUMENTS

JP 6-143641 * 5/1994 ..... 347/191

* cited by examiner

*Primary Examiner*—Huan Tran
(74) *Attorney, Agent, or Firm*—Sughrue, Mion, Zinn, Macpeak & Seas, PLLC

(57) ABSTRACT

The improved thermal head adjusting method used when an image is recorded onto a thermal recording material by applying a voltage to a thermal head in accordance with image data, comprises the steps of measuring an initial state of at least one of characteristic values of the thermal head and adjusting the voltage to be applied in accordance with the image data with respect to a reference voltage. According to this method, variation in densities caused by difference of and variation in individual thermal heads can be greatly reduced and a high quality homogeneous thermal image can be stably recorded without being affected by difference of thermal heads.

13 Claims, 4 Drawing Sheets

THERMAL HEAD ADJUSTING METHOD

BACKGROUND OF THE INVENTION

1. Field of the Invention

The present invention relates to a thermal head adjusting method capable of executing thermal recording in constant density without being affected by difference of individual thermal heads in thermal recording apparatuses using a thermal head.

2. Description of the Related Art

Thermal recording materials comprising a thermal recording layer on a substrate such as a film, which are hereunder referred to as thermal materials, are commonly used to record the images produced in diagnosis by ultrasonic scanning.

This recording method, commonly referred to as thermal image recording, eliminates the need for wet processing and offers several advantages including convenience in handling. Hence, the use of the thermal image recording system is not limited to small-scale applications such as diagnosis by ultrasonic scanning and an extension to those areas of medical diagnoses such as CT, MRI and X-ray photography where large and high-quality images are required is under review.

As is well known, thermal image recording involves the use of a thermal head having a glaze in which heat generating resistors constituting heat generating elements and used for heating the thermal recording layer of a thermal material to record an image are arranged in one direction and, with the glaze (heat generating elements) urged at small pressure against the thermal material (thermal recording layer), the two members are relatively moved in the direction perpendicular to the direction in which the glaze extends, and the respective heat generating elements of the glaze are heated imagewise by energy application to heat the thermal recording layer, thereby accomplishing image reproduction.

Recently, energy which is applied to the respective heat generating elements of the glaze is controlled by a pulse-width modulation which is effected by modulating an applied time with a constant applied voltage particularly in a medical use and the like which require high image quality.

Incidentally, even if thermal heads are manufactured based on the same design values, individual thermal heads have variation in glaze heights, glaze widths, protective layer thicknesses, heater sizes and the like of actually manufactured products and it is difficult to make them to perfectly coincide with their design values. Accordingly, since the individual thermal heads have a slightly different resistance value (for example, a maximum resistance value, an average resistance value) due to the variation and the like in the heater sizes, even if the same voltage is applied to the thermal heads, they have a different current value and, as a result, a different power is applied to the heat generating elements. Further, even if the same power is applied, since a recording portion has a different temperature due to the variation in the glazes and the thermal capacities of protective layers, recording is executed in a different density. Therefore, there is a problem that even if the same voltage is applied, the density is varied by the variation in the characteristics of thermal heads such as the glaze heights, glaze widths, protective layer thicknesses, heater sizes and the like of individual thermal heads.

The variation in the densities of images among thermal recording apparatuses is a large problem when it is required to record a high quality image, in particular, when an ultra-fine middle tone image is recorded. Particularly, the variation in the densities causes an obstruction in the observation of images and is a very serious problem in the uses such as the aforesaid medical use in which high quality ultra-fine middle tone images are required because an erroneous diagnosis may be made by the variation.

When the applied power is not properly controlled by the variation in the characteristics of the thermal heads and the applied power to the heat generating elements is made excessively large, there arises a problem that thermal stress to the thermal heads is increased and the durability thereof is lowered because a peak temperature which is reached by the heat generating elements is increased accordingly. In addition, printing failure such as thermal damage and the like may be caused to a thermal recording medium (for example, the unevenness of the surface of the thermal recording medium which is caused when the surface is softened by heat). To cope with this problem, it is required to lower the thermal recording medium peak temperature in such a degree as not to hinder thermal recording to thereby prevent the imposition of an unnecessarily high voltage to the thermal head, that is, to optimize the applied voltage.

SUMMARY OF THE INVENTION

An object of the present invention is to solve the problem of prior art and provide a thermal head adjusting method of permitting a thermal head to stably record a high quality homogeneous thermal image in a thermal recording apparatus using the thermal head without being affected by difference of individual thermal heads by lowering variation in densities caused by the difference of and variation in the individual thermal heads, eliminating the damage of a thermal recording medium and improving durability by preventing the deterioration and the reduction of capability of the thermal head due to heat.

In order to achieve the above object, the invention provides a thermal head adjusting method used when an image is recorded onto a thermal recording material by applying a voltage to a thermal head in accordance with image data, comprising the steps of:

measuring the initial states of characteristic values of the thermal head; and adjusting the voltage to be applied in accordance with the image data with respect to a reference voltage.

In a preferred embodiment, the characteristic values of the thermal head to be measured are at least one selected from a group composed of a glaze height H, a glaze width W, a protective film thickness d, a heater width l and a heater length L of the thermal head and a resistance value R of the thermal head.

In another preferred embodiment, when the reference values of the glaze height H, the glaze width W, the protective film thickness d, the heater width l, the heater length L and the resistance value R are represented by $H_0$, $W_0$, $d_0$, $l_0$, $L_0$ and $R_0$ and initial values measured are represented by $H_i$, $W_i$, $d_i$, $l_i$, $L_i$ and $R_i$, the rates of change $\Delta P_H$, $\Delta P_W$, $\Delta P_d$, $\Delta P_l$, $\Delta P_L$ of a power $P_0$ which is required to make recording in a maximum necessary density at the respective initial values $H_i$, $W_i$, $d_i$, $l_i$ and $L_i$ to the power $P_0$ are determined from predetermined relationships, respectively and a voltage V determined from the following formula (1) is applied to the thermal head;

$$V = \sqrt{\frac{(1+\Delta P_H)(1+\Delta P_W)(1+\Delta P_d)(1+\Delta P_l)(1+\Delta P_L)R_i}{R_0}} \cdot V_0 \quad (1)$$

where, $V_0$ is a voltage necessary to apply the power $P_0$ to the thermal head.

DETAILED DESCRIPTION OF THE INVENTION

The thermal head adjusting method of the invention will now be described in detail with reference to the preferred embodiments shown in the accompanying drawings.

Figure 1:
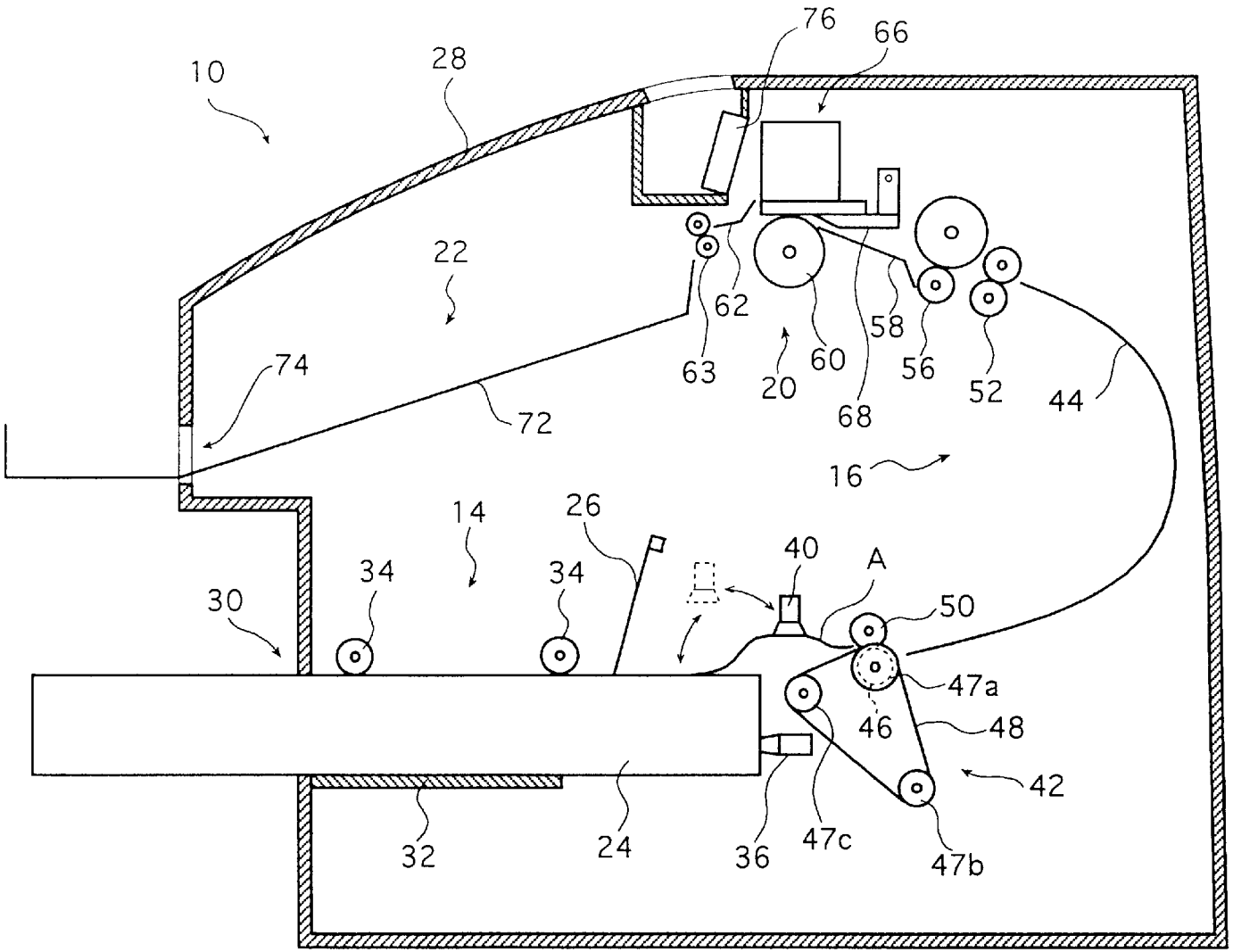
FIG. 1 is a schematic diagrammatic sectional view of an embodiment of a thermal recording apparatus embodying a thermal head adjusting method according to the present invention.

FIG. 1 shows a schematic diagrammatic sectional view of an embodiment of a thermal recording apparatus embodying a thermal head adjusting method according to the present invention.

Figure 3:
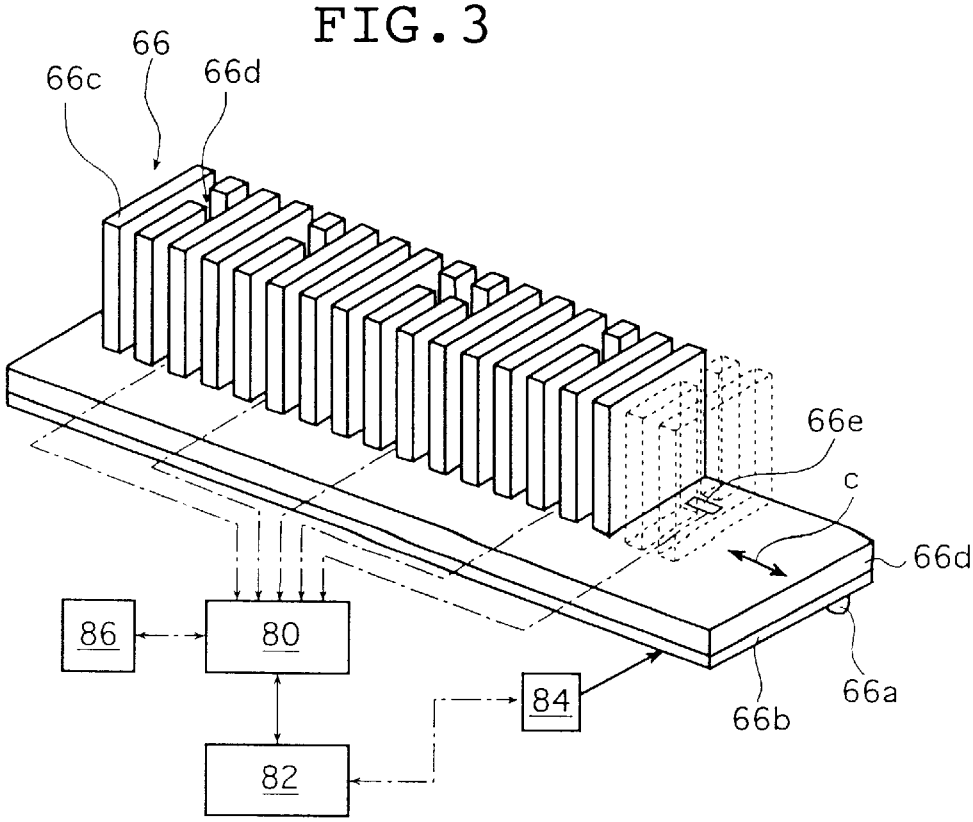
FIG. 3 is a schematic perspective view, partly in cross section, of a thermal head including a block diagram of a control system which is used in the recording unit shown in FIG. 2.

The thermal recording apparatus generally indicated by 10 in FIG. 1 and which is hereunder simply referred to as a "recording apparatus" performs thermal image recording on thermal recording materials of a given size, say, B4 (namely, thermal recording materials in the form of cut sheets, which are hereunder referred to as "thermal materials A"). The apparatus comprises a loading section 14 where a magazine 24 containing thermal materials A is loaded, a feed/transport section 16, a recording section 20 performing thermal image recording on thermal materials A by means of the thermal head 66, and an ejecting section 22. In addition, as shown in FIG. 3, the thermal head 66 in the recording section 20 is connected to an image processing unit 80 and a recording control unit 84, and the image processing unit 80 in turn is connected to a data storing unit 86.

In the thus constructed recording apparatus 10, the feed/transport section 16 transports the thermal material A to the recording section 20, where the thermal material A against which the thermal head 66 is pressed is transported in the direction perpendicular to the direction in which a glaze 66*a* extends (normal to the papers of FIGS. 1 and 2) and in the meantime, the individual heat generating elements are actuated imagewise to perform thermal image recording on the thermal material A.

The thermal materials A comprise respectively a substrate of film such as a transparent polyethylene terephthalate (PET) film, paper and the like which is overlaid with a thermal recording layer.

Typically, such thermal materials A are stacked in a specified number, say, 100 to form a bundle, which is either wrapped in a bag or bound with a band to provide a package. As shown, the specified number of thermal materials A bundled together with the thermal recording layer side facing down are accommodated in the magazine 24 of the recording apparatus 10, and they are taken out of the magazine 24 one by one to be used for thermal image recording.

The magazine 24 is a case having a cover 26 which can be freely opened. The magazine 24 which contains the thermal materials A is loaded in the loading section 14 of the recording apparatus 10.

The loading section 14 has an inlet 30 formed in the housing 28 of the recording apparatus 10, a guide plate 32, guide rolls 34 and a stop member 36; the magazine 24 is inserted into the recording apparatus 10 via the inlet 30 in such a way that the portion fitted with the cover 26 is coming first; thereafter, the magazine 24 as it is guided by the guide plate 32 and the guide rolls 34 is pushed until it contacts the stop member 36, whereupon it is loaded at a specified position in the recording apparatus 10.

The feed/transport section 16 has the sheet feeding mechanism using the sucker 40 for grabbing the thermal material A by application of suction, transport means 42, a transport guide 44 and a regulating roller pair 52 located in the outlet of the transport guide 44; the thermal materials A are taken out of the magazine 24 in the loading section 14 and transported to the recording section 20.

The transport means 42 is composed of a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that is to be pressed onto the transport roller 46. The forward end of the thermal material A which has been sheet-fed by means of the sucker 40 is pinched between the transport roller 46 and the nip roller 50 such that the material A is transported downstream.

When a signal for the start of recording is issued, the cover 26 is opened by the OPEN/CLOSE mechanism (not shown) in the recording apparatus 10. Then, the sheet feeding mechanism using the sucker 40 picks up one sheet of thermal material A from the magazine 24 and feeds the forward end of the sheet to the transport means 42 (to the nip between rollers 46 and 50). At the point of time when the thermal material A has been pinched between the transport roller 46 and the nip roller 50, the sucker 40 releases the material, and the thus fed thermal material A is supplied by the transport means 42 into the regulating roller pair 52 as it is guided by the transport guide 44. At the point of time when the thermal material A to be used in recording has been completely ejected from the magazine 24, the OPEN/CLOSE mechanism closes the cover 26.

The distance between the transport means 42 and the regulating roller pair 52 which is defined by the transport guide 44 is set to be somewhat shorter than the length of the thermal material A in the direction of its transport. The advancing end of the thermal material A first reaches the regulating roller pair 52 by the transport means 42. The regulating roller pair 52 are normally at rest. The advancing end of the thermal material A stops here and is subjected to positioning.

When the advancing end of the thermal material A reaches the regulating roller pair 52, the temperature of the thermal head 66 (glaze 66*a*) is checked and if it is at a specified level, the regulating roller pair 52 start to transport the thermal material A, which is transported to the recording section 20.

Figure 2:
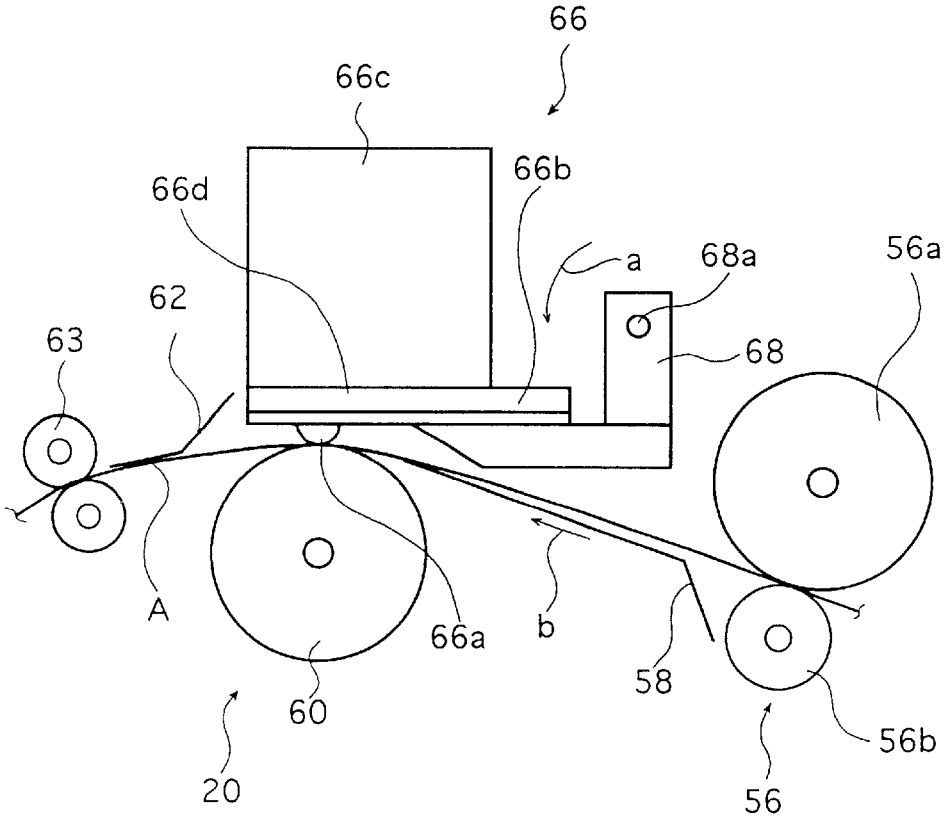
FIG. 2 is a partly enlarged diagrammatic sectional view of the recording unit of the thermal recording apparatus shown in FIG. 1.

FIG. 2 shows schematically the recording section 20.

The recording section 20 has the thermal head 66, a platen roller 60, a cleaning roller pair 56, a guide 58, a fan 76 for cooling the thermal head 66 (see FIG. 1) and a guide 62. The thermal head 66 is capable of thermally recording sheets of up to B4 size at a recording (pixel) density of, say, about 300 dpi. The head comprises a ceramic substrate 66*b* made of an electrical insulating material excellent in heat resistance such as alumina ceramic in which a plurality of heat generating resistors 90 constituting the heat generating elements (see FIGS. 4(*a*) and (*b*)) performing thermal recording on the thermal material A are arranged in one direction (longitudinal direction normal to the papers of FIGS. 1 and 2), a base 66*d* made of a metal plate such as aluminum which is laminated on the side opposite to the glaze 66*a* side of the ceramic substrate 66*b* and a heat sink 66*c* fixed on the other surface of the base 66*d*; the latter having a number of radiating fins (see FIG. 3) and being made of a metal such as aluminum. The thermal head 66 is supported on a support member 68 that can pivot about a fulcrum 68*a* either in the direction of arrow a or in the reverse direction.

Then, the platen roller 60 rotates at a specified image recording speed while holding the thermal material A in a specified position, and transports the thermal material A in the direction perpendicular to the main scanning direction (direction of arrow b in FIG. 2).

The cleaning roller pair 56 consists of an adhesive rubber roller 56*a* made of an elastic material and a non-adhesive roller 56*b*. The adhesive rubber roller 56*a* picks up dirt and other foreign matter that has been deposited on the thermal recording layer in the thermal material A, thereby preventing the dirt from being deposited on the glaze 66*a* or otherwise adversely affecting the image recording operation.

Before the thermal material A is transported to the recording section 20, the support member 68 in the illustrated recording apparatus 10 has pivoted to UP position (in the direction opposite to the direction of arrow a) so that the thermal head 66 (or glaze 66*a*) is not in contact with the platen roller 60.

When the transport of the thermal material A by the regulating roller pair 52 starts, said material is subsequently pinched between the cleaning rollers 56 and transported as it is guided by the guide 58. When the advancing end of the thermal material A has reached the record START position (i.e., corresponding to the glaze 66*a*), the support member 68 pivots in the direction of arrow a and the thermal material A becomes pinched between the glaze 66*a* in the thermal head 66 and the platen roller 60 such that the glaze 66*a* is pressed onto the recording layer while the thermal material A is transported in the direction indicated by arrow b by means of the platen roller 60 (as well as the regulating roller pair 52 and the transport roller pair 63) as it is held in a specified position.

During this transport, the individual heat generating resistors 90 on the glaze 66*a* are actuated imagewise to perform thermal image recording on the thermal material A.

Figure 4A:
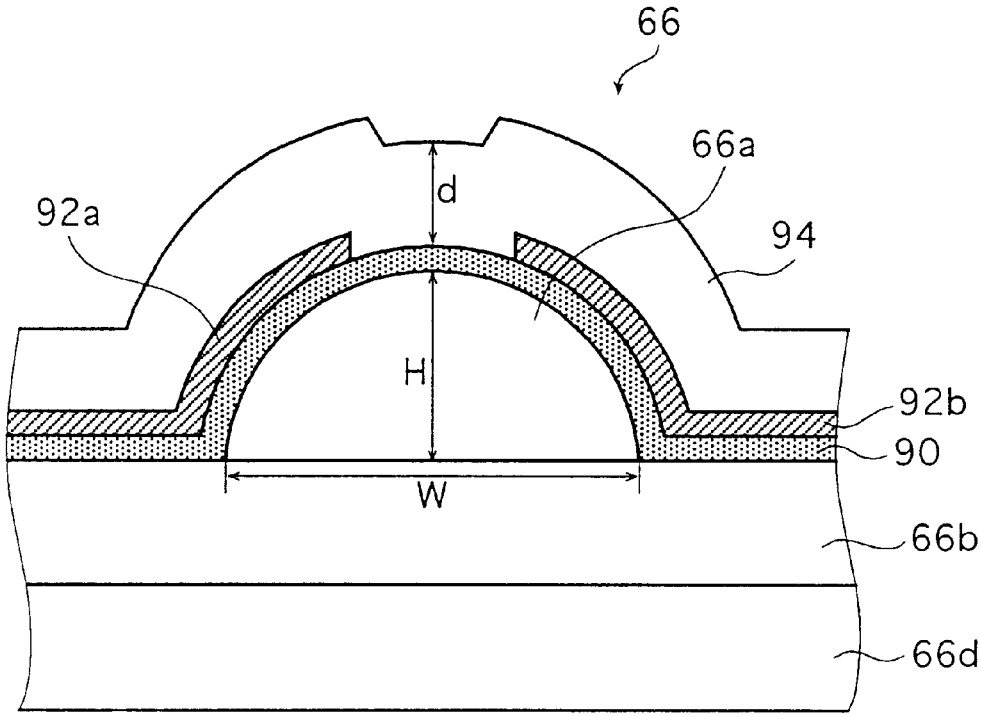
FIGS. 4(*a*) and (*b*) are a partly enlarged diagrammatic sectional view showing an arrangement of the thermal head shown in FIG. 3 and a diagrammatic representation of the upper surface of a part thereof, respectively.
Figure 4B:
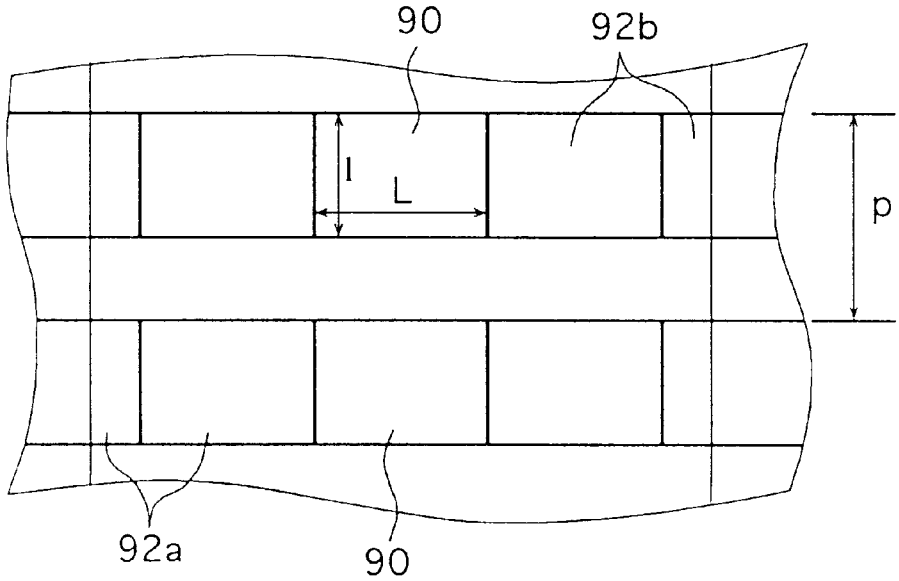
Figure 5A:
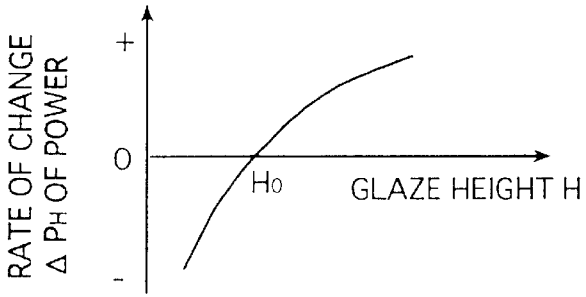
FIGS. 5(*a*), (*b*), (*c*), (*d*) and (*e*) are examples of graphs showing relationships between a glaze height (H), glaze width (W), protective layer thickness (*d*), heater width (*l*) and heater length (L) and rates of change of an applied power $\Delta P_H$, $\Delta P_W$, $\Delta P_d$, $\Delta p_l$, $\Delta P_L$.
Figure 5B:
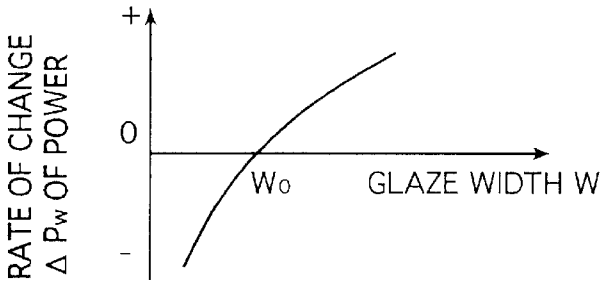
Figure 5C:
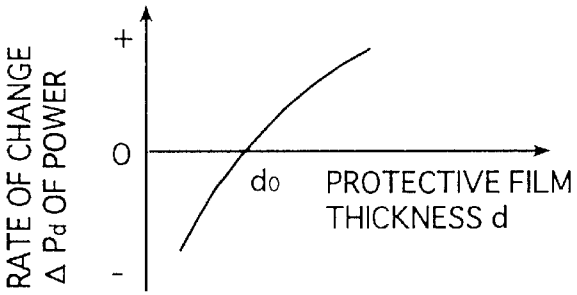
Figure 5D:
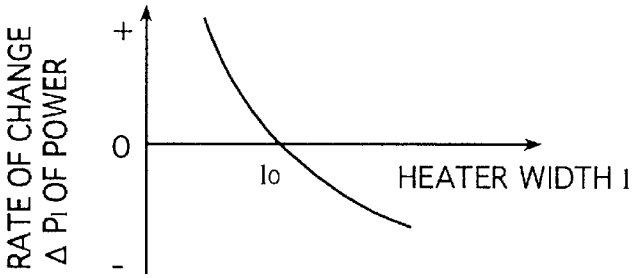
Figure 5E:
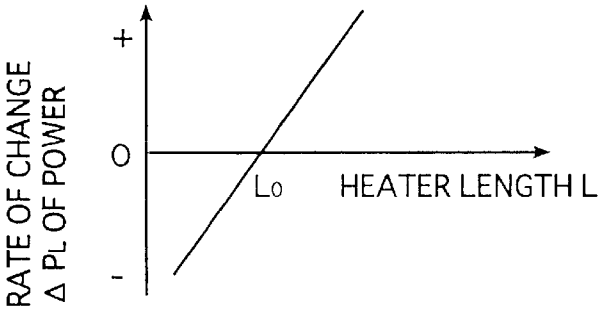

FIG. 3 shows a schematic perspective view, partly in cross section, of the thermal head 66 and a control block diagram thereof, and FIGS. 4(*a*) and (*b*) are a partially sectional view showing in detail the glaze 66*a* of the thermal head 66 and a diagrammatic representation of the upper surface of a part thereof, respectively.

As FIG. 3 shows, the thermal head 66 comprises the glaze 66*a*, the ceramic substrate 66*b*, the heat sink 66*c* and the base 66*d* as described above. A plurality of fins of the heat sink 66*c* in the thermal head 66 have cutouts 66*f* formed at a specified distance for example at five sites of the area corresponding to the glaze 66*a* and thermistors 66*e* for measuring the temperature of the glaze 66*a* in each of the pixels are provided at the base of the heat sink 66*c* at those sites. These thermistors 66*e* detect the temperature of the glaze 66*a* (that is, the temperature of the heat generating resistors 90 in the cutout portion (see FIGS. 4 (*a*) and (*b*)) and send the detection results to the image processing unit 80 to be described below, as shown by chain lines. The image processing unit 80 receives the detection results and calculates the temperature of the respective heat generating resistors 90 for example by linear interpolation.

Next, as shown in FIG. 4(*a*), the glaze 66*a* of a thermal head 66 is a heat accumulator which is formed on the ceramic substrate 66*b* to accumulate the heat generated by a heat generating resistor 90 and composed of glass or a polyimide resin formed to a semicircular or semi-elliptic shape and having a height H (glaze height) and width (glaze width) W. The heat generating resistor 90 is laminated on the glaze 66*a*. As shown in FIG. 4(*b*), the heat generating resistor 90 is composed of a band-shaped tantalum nitride ($Ta_2N$) or the like which extends onto the ceramic substrate 66*b* on both the sides of the glaze 66*a* and has a width (heater width) l. The heat generating resistors 90, as many in number as pixels necessary to, one line, are disposed at a predetermined pitch p of each pixel, for example, at intervals of 84.7 $\mu$m when a recording pixel density is 300 dpi.

A pair of electrodes 92*a*, 92*b* each composed of aluminum, copper or the like and having substantially the same width are laminated on the heat generating resistor 90 except the central portion thereof. The heat generating resistor 90 is not covered with the electrodes 92*a* and 92*b* between them over the length (the length of the heater) L and exposed to the outside. The exposed portion is located at a position confronting the top of the glaze 66*a* and corresponds to the dots of one pixel which causes a thermal material A, to which the heat generated by the heat generating resistor 90 is applied through a protective film 94, to develop color. The protective film 94 composed of a material excellent in wear resistance and having a film thickness (protective film thickness) d is laminated on and above the entire surfaces of the pair of electrodes 92*a*, 92*b*, the heat generating resistor 90, the glaze 66*a* and the ceramic substrate 66*b*. The material includes silicon carbide (SiC), silicon nitride (SiN), tantalum pentoxide ($Ta_2O_5$), and glass containing nitrogen such as SIALON (Si—Al—O—N) and LASION (La—Si—O—N), etc. The portion of the glaze 66*a* of the thermal head 66 is made by a technology for manufacturing a semiconductor device and the like such as, for example, CVD, PVD, sputtering, vapor deposition, photolithography and the like. As a result, since the protective film 94 is vapor deposited on the electrodes 92*a*, 92*b* which are formed by etching or the like, the recess between the electrodes 92*a* and 92*b* forms a similar recess to the top of the protective film 94. The thermal head 66 and, in particular, the portion of the glaze 66*a* is basically arranged as described above.

As FIG. 3 shows, the system for controlling the recording with the thermal head 66 is essentially composed of the image processing unit 80 which subjects image data from an image data supply source to image processing operations including sharpness compensation; an image memory 82 for storing the processed image data and the like; and the recording control unit 84 which controls the thermal recording with the thermal head 66 based on these image data. The image processing unit 80 is connected to the data storing unit 86 for storing correction data for use in various image processing operations in the image processing unit 80.

Image data from an image data supply source such as CT or MRI is sent to the image processing unit 80 as 10-bit (0–1023) digital data.

The image processing unit 80 is the combination of various kinds of image processing circuits and memories; it receives image data from an image supply source and performs specified image processing jobs, such as sharpness compensation for edge enhancement of the thermal recording image, tone correction for producing an appropriate image in accordance with the gamma value of the thermal material A, the thermal recording apparatus used, especially thermal head, temperature compensation for adjusting the energy of heat generation in accordance with the temperature of heat generating elements in the thermal head, shading compensation for correcting the uneven density caused by the shape variability in the longitudinal direction and other factors of the glaze in the thermal head, resistance compensation for correcting the difference between the resistances of individual heat generating elements, and black ratio compensation for ensuring that image data representing the same density will yield a color of the same density in spite of the variation in the drop of supply voltage to the thermal head due to the change in the pattern to be recorded; if necessary, the image processing unit 80 may perform formatting (i.e., enlargement or reduction and frame assignment), whereupon the data for the image to be thermally recorded by means of the thermal head 66 is delivered as an output to the image memory 82.

The image processing unit 80 subjects image data from an image data supply source such as CT or MRI to image processing jobs such as sharpness compensation, tone correction, temperature compensation, shading correction, resistance compensation and black ratio correction. Upon optional for matting, there are produced image data in association with the thermal recording to be done with the thermal head 66 and these image data are stored in the image memory 82.

The recording control unit 84 reads the stored image data sequentially out of the image memory 82 line by line in the direction in which the glaze 66*a* in the thermal head 65 extends. The control unit 84 then supplies the thermal head 66 with a recording signal representing each of the thusly read image data (or the duration of time for which voltage is applied imagewise, in the pulse-width modulation).

The heat generating resistors 90 located in the respective pixels in the thermal head 66 generate heat in accordance with the received recording signal and, as already described above, thermal image recording is performed on the thermal material A as it is transported in the direction of arrow b by such means of transport as the platen roller 60.

The thermal image recording is performed imagewise by pulse-width modulation which comprises modulating the time of voltage application in accordance with the density under a constant voltage.

It should be noted that the recording method to which the invention can be applied is not limited to the pulse-width modulation, but intensity modulation which comprises modulating the voltage in accordance with the density under a constant application time may be adopted.

After the end of thermal image recording, the thermal material A as it is guided by the guide 62 is transported by the platen roller 60 and a transport roller pair 63 to be ejected into a tray 72 in the ejecting section 22. The tray 72 projects exterior to the recording apparatus 10 via the outlet 74 formed in the housing 28 and the thermal material A carrying the recorded image is ejected via the outlet 74 for takeout by the operator.

As described above, the recording apparatus 10 exemplified in the drawing can stably obtain a high quality image without being affected by a temperature of the thermal head 66, a recording speed and a γ value of the thermal material A when it is properly adjusted at the time of shipping. However, even if the temperature of the glaze 66*a* measured by the thermistor 66*e*, the recording speed, the γ value of the thermal material and the like are the same, if individual thermal heads 66 are dispersed, there is caused variation in the densities of images thermally recorded by the recording apparatuses as described above.

The inventor has found from the thermal head 66, in particular, from the structure of the glaze 66*a* that the characteristic values of the thermal head 66 which affect the variation in the densities among the recording apparatuses include, as shown in FIGS. 4(*a*) and (*b*), a glaze height H and a glaze width W which are sizes representative of the volume of the glaze 66*a* acting as the heat accumulator of the heat generated by the heat generating resistor 90, a thickness (protective film thickness) d of the protective film 94 for transmitting the heat generated by the heat generating resistor 90, a width (heater width) l of the heat generating resistor 90 for generating the heat, and an exposed length (heater length) L between the electrodes 92*a* and 92*b*. The inventor has further found that the variation in the densities among the apparatuses can be greatly lowered by adjusting an applied voltage in accordance with the variation in the characteristic values of the individual thermal heads when the apparatuses are shipped or the thermal head is replaced.

More specifically, the glaze height H, glaze width W, protective layer thickness d, heater width l, heater length L and the like of the characteristic values of the thermal head 66 are characteristic values which put the initial difference (dispersion) of the thermal heads in question by which a density is initially dispersed among the apparatuses and accordingly image quality is made different among them.

An applied power P used here means an applied power required to develop color having a maximum density which is necessary to actual recording (hereinafter, this is referred to as a maximum necessary density which is, for example, 3.0), that is, an applied power which is applied to image data representative of, for example, the maximum density (for example, 255 in 8-bit data).

A reference power $P_0$ means a power which is to be applied to develop color having the maximum necessary density when the glaze height, glaze width, protective layer thickness, heater width and heater length are set to arbitrary reference values (for example, design values) $H_0$, $W_0$, $d_0$, $l_0$ and $L_0$ (the resistance of the heat generating resistor per one dot at the time is shown by $R_0$). Further, a voltage necessary to apply the power $P_0$ to the thermal head is shown by $V_0$.

Although both the applied power P and the reference power $P_0$ are set in correspondence to the maximum necessary density, this is because that densities lower than the maximum necessary density, that is, all the density gradations necessary to actual recording can be obtained by making adjustment based on the maximum necessary density by, for example, shortening an applied time stepwise in a pulse width modulation. However, the reference power $P_0$ in the present invention is not limited to the one set in correspondence to the maximum necessary density and may be set using any arbitrary density lower than the maximum necessary density as a reference.

Since the glaze 66*a* of the thermal head 66 is a portion for accumulating the heat generated by the heat generating resistor 90, an increase in its volume increases the thermal capacity thereof. Therefore, when the thermal capacity changes, a different temperature and thus a different density are obtained even if the same power (namely, the same quantity of heat) is applied. Typical parameters for regulating the volume of the glaze 66*a* are the glaze height H and the glaze width W. That is, since an increase in the glaze height H and the glaze width W increases the thermal capacity, to output the same density, a power which is applied to the thermal head 66 must be increased in accordance with the increase of the thermal capacity.

As a result, when the glaze width, protective film thickness, heater width and heater length are set to the reference values $W_0$, $d_0$, $l_0$ and $L_0$, respectively and only the glaze height H is changed, a relationship between the rate of change $\Delta P_H$ of the applied power P to the reference power $P_0$ and the glaze height H can be represented by a graph as shown in FIG. 5(*a*) and the following formula (2), respectively.

Further, when the glaze height, protective film thickness, heater width and heater length are set to the reference values $H_0$, $d_0$, $l_0$ and $L_0$, respectively and only the glaze width W is changed, a relationship between the rate of change $\Delta P_W$ of the applied power P to the reference power $P_0$ and the glaze width W can be represented by a graph as shown in FIG. 5(*b*) and the following formula (3), respectively.

$$P=(1+\Delta P_H)P_0 \quad (2)$$

$$P=(1+\Delta P_W)P_0 \quad (3)$$

The protective film 94 is formed to protect the heat generating resistor 90 of the glaze 66*a* of the thermal head 66 and the electrodes 92*a*, 92*b*. However, since a heat transmission time is changed by the film thickness d of the protective film 94 and the heat capacity is also changed as a result of the change of the heat transmission time, a different temperature and thus a different color density are obtained even if the same power is applied. That is, an increase in the film thickness d increases the heat transmission time, to develop color of the same density, the power which is applied to the thermal head 66 must be increased in accordance with the increase of the heat transmission time.

As a result, when the glaze height, glaze width, heater width and heater length are set to the reference values $H_0$, $W_0$, $l_0$ and $L_0$, respectively and only the protective film thickness d is changed, a relationship between the rate of change $\Delta P_d$ of the applied power P to the reference power $P_0$ and the protective film thickness d of the glaze 66*a* can be represented by a graph as shown in FIG. 5(*c*) and the following formula (4), respectively.

$$P=(1+\Delta P_d)P_0 \quad (4)$$

The heater width l and the heater length L represent the width and length of the portion where the heat generating resistor 90 is not covered with the electrodes 92*a*, 92*b*. However, since an increase in the heater length L increases the resistance value, decreases a current value and thus a power, the power to be applied to the thermal head 66 must be increased. Whereas, since an increase in the heater width l decreases the resistance value, increases the current value and thus the power, the power to be applied to the thermal head 66 must be decreased.

Therefore, when the glaze height, glaze width, protective film thickness and heater length are set to the reference values $H_0$, $W_0$, $d_0$ and $L_0$, respectively and only the heater width l is changed, a relationship between the rate of change $\Delta P_l$ of the applied power P to the reference power $P_0$ and the heater width l of the glaze 66*a* can be represented by a graph as shown in FIG. 5(*d*) and the following formula (5), respectively. Further, when the glaze height, glaze width, protective film thickness and heater width are set to the reference values $H_0$, $W_0$, $d_0$ and $l_0$, respectively and only the heater length L is changed, a relationship between the rate of change $\Delta P_L$ of the applied power P to the reference power $P_0$ and the heater length L can be represented by a graph as shown in FIG. 5(*e*) and the following formula (6), respectively.

$$P=(1+\Delta P_l)P_0 \quad (5)$$

$$P=(1+\Delta P_L)P_0 \quad (6)$$

In the present invention, relationships between the rates of change $\Delta P_H$, $\Delta P_W$, $\Delta P_d$, $\Delta p_l$, and $\Delta P_L$, of the applied power and the glaze height H, glaze width W, protective film thickness d, heater width l and heater length L, for example, the relationships as shown in FIG. 5(*a*) to FIG. 5(*e*) are previously determined as to each of the thermal heads 66 to be used. Although the value of the reference power $P_0$ is necessary to determine the relationships, a value calculated by the following formula (7) is used for it by measuring a resistance value (reference resistance value) $R_0$ in the reference values $H_0$, $W_0$, $d_0$, $l_0$ and $L_0$ and a reference voltage $V_0$ to be applied to obtain the maximum necessary density at the time. The resistance value to be measured may be any of a maximum resistance value and an average resistance value and is not particularly limited.

$$P_0=V_0^2/R_0 \quad (7)$$

When an image recording apparatus is shipped from factory or a thermal head is replaced, the characteristic values of the respective thermal heads 66 are measured using a microscope or the like before they are used. It is assumed that the measured values indicating the initial dispersion in the characteristic values of the respective thermal heads are a glaze height $H_i$, glaze width $W_i$, protective film thickness $d_i$, heater width $l_i$ and heater length $L_i$, respectively. Further, a resistance value $R_i$ of the thermal heads 66 is also measured.

When it is assumed that the respective measured values $H_i$, $W_i$, $d_i$, $l_i$ and $L_i$ of the glaze height H, glaze width W, protective film thickness d, heater width l and heater length L which show the volume of the glaze 66*a* are dispersed from the reference values $H_0$, $W_0$, $d_0$, $l_0$ and $L_0$, respectively, the rates of change $\Delta P_H$, $\Delta P_W$, $\Delta P_d$, $\Delta P_l$, and $\Delta P_L$ of the applied power to the reference power $P_0$ are calculated from the relationships shown by FIG. 5(*a*) to FIG. 5(*e*), respectively.

When all of the thus obtained $\Delta P_H$, $\Delta P_W$, $\Delta P_d$, $\Delta p_l$ and $\Delta P_L$ are taken into consideration, the applied power P which is necessary to develop color having the maximum necessary density can be represented by the following formula (8). The formula (8) is represented as shown in a formula (9). The applied power P is represented by the following formula (10) when the applied voltage is denoted by V. Therefore, a voltage which is to be applied to develop color having the maximum necessary density (applied voltage to be applied to image data corresponding to the maximum density) can be calculated from the following formula (12) which is obtained by substituting the formula (7) for a formula (11) which is obtained from the formulas (9) and (10). Note, all of $\Delta P_H$, $\Delta P_W$, $\Delta P_d$, $\Delta P_l$, and $\Delta P_L$ need not be used in the calculation of the applied power P and it may be calculated using at least one of them.

$$P = (1+\Delta P_H)(1+\Delta P_W)(1+\Delta P_d)(1+\Delta P_l)(1+\Delta P_L)P_0 \quad (8)$$

$$= (1+\Delta P)P_0 \quad (9)$$

$$= \frac{V^2}{R_i} \quad (10)$$

$$V = \sqrt{(1+\Delta P)P_0 R_i} \quad (11)$$

$$= \sqrt{\frac{(1+\Delta P)R_i}{R_0}} \cdot V_0 \quad (12)$$

Although $(1+\Delta P)$ represents $(1+\Delta P_H)$ $(1+\Delta P_W)$ $(1+\Delta P_d)$ $(1+\Delta P_l)$ $(1+\Delta P_L)$, here, at least one of $\Delta P_H$, $\Delta P_W$, $\Delta P_d$, $\Delta P_l$, and $\Delta P_L$ may be used in the present invention.

When certain image data is processed, a voltage to be applied to the thermal head 66 in accordance with the image data is adjusted using the above applied voltage V which is corrected to correspond to the image data showing the maximum density. With this operation, the variation in the densities caused by the difference of and the variation in the individual thermal heads can be greatly reduced.

Further, since the properly corrected voltage is applied, a peak temperature of the glaze 66*a* is not excessively high by the imposition of an excessive voltage on the image data having the maximum density, whereby the damage of a thermal recording medium can be reduced and the deterioration and the reduction of durability of the thermal head due to heat can be prevented.

To adjust the thermal head as described above, it suffices only to previously store the relationships between the rates of change $\Delta P_H$, $\Delta P_W$, $\Delta P_d$, $\Delta P_l$, and $\Delta P_L$ of the applied power and the glaze height H, glaze width W, protective film thickness d, heater width l and heater length L (the relationships as shown in, for example, FIG. 5(*a*) to FIG. 5(*e*)) in the data storing unit 86 of the control system of the thermal head 66, respectively, calculate the applied voltage by the image processing unit 80 or a not shown controller based on the above relationships and the respective measured values of the thermal head input from the outside and automatically adjust the voltage to be applied to the thus obtained applied voltage by the recording control unit 84.

The present invention is not limited to the above arrangement and the applied voltage V may be calculated externally of the apparatus based on the respective measured values of the thermal head and the applied voltage in the apparatus may be manually adjusted to the thus obtained applied voltage V.

The protective film 94 of the glaze 66*a* of the thermal head 66 is worn by running and lapping and the protective film thickness d of the protective film 94 is reduced as time passes. To cope with this problem, the applied voltage may be adjusted in accordance with the change of the protective film thickness d which is caused as time passes.

In this case, a relationship between an amount with the passage of time which increases as time passes such as a period of time of use of the thermal head 66, a recording time, a number of records (recorded films), a recorded data history (an amount of recorded characters) or the like and a change with the passage of time of the protective film thickness d which changes as time passes is previously determined and stored in, for example, the data storing unit 86.

When thermal recording is executed by the recording apparatus 10 and it is determined that the period of time of use of the thermal head 66, the recording time, the number of records or the recording data history (amount of recorded characters) has reached a predetermined amount with the passage of time, the image processing unit 80 predicts a wear amount of the protective film thickness d which has been worn in accordance with the change with the passage of time from the relationship between the change with the passage of time of the protective film thickness d and the amount with the passage of time stored in the data storing unit 86. Next, the image processing unit 80 calculates the rate of change $\Delta P_d$ of the power at the predicted protective film thickness d based on the reference power $P_0$ at the reference value $d_0$ of the protective film thickness, determines the applied voltage V and adjusts the voltage to be applied to the thermal head 66 to V. With this operation, the time sequential change (increase) of the density caused by the wear with age of the thermal head 66 can be compensated, whereby an image can be recorded in a stable density in time sequence.

The thermal head adjusting method of the present invention is carried out as described above.

Although the thermal head adjusting method of the present invention has been described above in detail, the present invention is by no means limited to the above arrangement and it goes without saying that various improvements as well as changes in design may be made within the scope which does not depart from the gist of the present invention.

As described above in detail, according to the present invention, variation in densities caused by difference of and variation in individual thermal heads can be greatly reduced in thermal recording using the thermal head. Further, the adjustment of the applied voltage in accordance with the maximum necessary voltage permits the damage of the thermal recording medium caused by heat to be eliminated and the deterioration and the reduction of capability of the thermal head due to heat to be prevented to thereby improve durability. Therefore, a high quality homogeneous thermal image can be stably recorded without being affected by difference of thermal heads.

What is claimed is:

1. A thermal head adjusting method used when an image is recorded onto a thermal recording material by applying a voltage to a thermal head in accordance with image data, comprising the steps of:

measuring initial states of characteristic values of the thermal head; and adjusting the applied voltage, with respect to a reference voltage, based on the measured initial states;

wherein the characteristic values of the thermal head to be measured comprise a heater resistance value R of the thermal head and at least one value selected from the group consisting of a glaze width W, a protective film thickness d, a heater width l and a heater length L of the thermal head.

2. A thermal head adjusting method according to claim 1, wherein the characteristic values of the thermal head to be measured comprise the glaze height H the heater resistance value R of the thermal head and at least one value selected from the group consisting of the glaze width W, the protective film thickness d, the heater width l and the heater length L of the thermal head.

3. A thermal head adjusting method according to claim 1, wherein the glaze width W, the protective film thickness d, the heater width l, the heater length L and the heater resistance value R have reference values represented by $w_0$, $d_0$, $l_0$, $L_0$ and $R_0$, respectively, and measured initial values represented by $W_i$, $d_i$, $l_i$, $L_i$ and $R_i$, respectively, and wherein the rates of change $\Delta P_W$, $\Delta P_d$, $\Delta P_l$, $\Delta P_L$ of an applied power P, which is required to record a maximum necessary density at the respective initial values $W_i$, $d_i$, $l_i$ and $L_i$, to a reference power $P_0$ are determined from predetermined relationships, respectively, and the applied voltage, V, determined from the following formula (1) is applied to the thermal head:

$$V = \sqrt{\frac{(1+\Delta P_W)(1+\Delta P_d)(1+\Delta P_l)(1+\Delta P_L)R_i}{R_0}} \cdot V_0 \quad (1)$$

wherein $V_0$ is a voltage necessary to apply the reference power $P_0$ to the thermal head.

4. A thermal head adjusting method according to claim 1, further comprising:

adjusting the applied voltage according to a change of the protective film thickness d caused by wear of the thermal head.

5. A thermal head adjusting method used when an image is recorded onto a thermal recording material by applying a voltage to a thermal head in accordance with image data, comprising the steps of:

measuring an initial state of at least one of characteristic values of the thermal head wherein the characteristic values of the thermal head to be measured are at least one selected from a group consisting of the glaze height H, glaze width W, a protective film thickness d, a heater width l and a heater length L of the thermal head and a heater resistance value R of the thermal head;

adjusting the applied voltage, with respect to a reference voltage, based on the measured initial state;

applying the applied voltage, V, determined from the following formula (1), to the thermal head:

$$V = \sqrt{\frac{(1+\Delta P_H)(1+\Delta P_W)(1+\Delta P_d)(1+\Delta P_l)(1+\Delta P_L)R_i}{R_0}} \cdot V_0; \text{ and} \quad (1)$$

wherein the characteristic values of the glaze height H, the glaze width W, the protective film thickness d, the heater width l, the heater length L and the heater resistance value R have reference values represented by $h_0$, $w_0$, $d_0$, $l_0$, $L_0$ and $R_0$, respectively, and measured initial values represented by $H_i$, $W_i$, $d_i$, $l_i$, $L_i$ and $R_i$, respectively, and wherein the rates of change $\Delta P_H$, $\Delta P_W$, $\Delta P_d$, $\Delta P_l$, $\Delta P_L$ of an applied power P, which is required to record a maximum necessary density at the respective measured initial values $H_i$, $W_i$, $d_i$, $l_i$ and $L_i$, to a reference power $P_0$ are determined from predetermined relationships, respectively, and wherein $V_0$ is a voltage necessary to apply the reference power $P_0$ to the thermal head.

6. A thermal head adjusting method according to claim 5, further comprising:

adjusting the applied voltage according to a change of the protective film thickness d caused by wear of the thermal head.

7. A thermal head adjusting apparatus for use when an image is recorded onto a thermal recording material by applying a voltage to a thermal head in accordance with image data, comprising:

a data storing unit for storing at least one of a plurality of predetermined relationships between rates of change $\Delta P_H$, $\Delta P_W$, $\Delta P_d$, $\Delta P_l$, and $\Delta P_L$ of an applied power P and a glaze height H, a glaze width W, a protective film thickness d, a heater width l and a heater length L, respectively; and an image processing unit for calculating the applied voltage, based on at least one of the at least one predetermined relationship stored in the data storing unit;

wherein the glaze height H, the glaze width W, the protective film thickness d, the heater width l, the heater length L and a heater resistance value R of the thermal head have reference values represented by $h_0$, $w_0$, $d_0$, $l_0$, $L_0$ and $R_0$, respectively, and measured initial values represented by $H_i$, $W_i$, $d_i$, $l_i$, $L_i$ and $R_i$, respectively, and wherein at least one of the plurality of rates of change $\Delta P_H$, $\Delta P_W$, $\Delta P_d$, $\Delta P_l$, $\Delta P_L$ of the applied power P, which is required to record a maximum necessary density at the respective initial values $H_i$, $W_i$, $d_i$, $l_i$ and $L_i$, to a reference power $P_0$ is determined from the predetermined relationships, respectively, and wherein the image processing unit calculates the applied voltage V based on the following formula (1):

$$V = \sqrt{\frac{(1+\Delta P_H)(1+\Delta P_W)(1+\Delta P_d)(1+\Delta P_l)(1+\Delta P_L)R_i}{R_0}} \cdot V_0 \quad (1)$$

wherein $V_0$ is a voltage necessary to apply the reference power $P_0$ to the thermal head.

8. A thermal head adjusting method used when an image is recorded onto a thermal recording material by applying a voltage to a thermal head in accordance with image data, comprising the steps of:

measuring an initial state of at least one of characteristic values of the thermal head; and adjusting the applied voltage, with respect to a reference voltage, based on the measured initial state;

wherein the characteristic values of the thermal head to be measured comprise at least one value selected from the group consisting of a glaze width W, a protective film thickness d, a heater width l of the thermal head a heater length L of the thermal head, and a heater resistance value R of the thermal head;

wherein the glaze width W, the protective film thickness d, the heater width l, the heater length L and the heater resistance value R have reference values represented by $w_0$, $d_0$, $l_0$, $L_0$ and $R_0$, respectively, and measured initial values represented by $W_i$, $d_i$, $l_i$, $L_i$ and $R_i$, respectively, and wherein the rates of change $\Delta P_w$, $\Delta P_d$, $\Delta P_l$, $\Delta P_L$ of an applied power P, which is required to record a maximum necessary density at the respective initial values $W_i$, $d_i$, $l_i$ and $L_i$, to a reference power $P_0$ are determined from predetermined relationships, respectively, and the applied voltage, V, determined from the following formula (1) is applied to the thermal head:

$$V = \sqrt{\frac{(1+\Delta P_W)(1+\Delta P_d)(1+\Delta P_l)(1+\Delta P_L)R_i}{R_0}} \cdot V_0 \quad (1)$$

wherein, $V_0$ is a voltage necessary to apply the power $P_0$ to the thermal head.

9. A thermal head adjusting method used when an image is recorded onto a thermal recording material by applying a voltage to a thermal head in accordance with image data, comprising the steps of:

measuring an initial state of at least one of characteristic values of the thermal head;

adjusting the applied voltage, with respect to a reference voltage, based on the measured initial state; and adjusting the applied voltage according to a change of the protective film thickness d caused by wear of the thermal head;

wherein the characteristic values of the thermal head to be measured comprise at least one value selected from the group consisting of a glaze width W, a protective film thickness d, a heater width l of the thermal head a heater length L of the thermal head, and a heater resistance value R of the thermal head.

10. A thermal head adjusting method used when an image is recorded onto a thermal recording material by applying a voltage to a thermal head in accordance with image data, comprising the steps of:

measuring an initial state of at least one of characteristic values of the thermal head; and adjusting the applied voltage, with respect to a reference voltage, based on the measured initial state, to achieve a substantially standard thermal head output density for reducing variations among output densities of the thermal head and at least one other thermal head;

wherein the characteristic values of the thermal head to be measured comprise a heater resistance value R of the thermal head and at least one value selected from the group consisting of a glaze width W, a protective film thickness d, a heater width l and a heater length L of the respective thermal heads.

11. A thermal head adjusting method according to claim 10, wherein the characteristic values of the thermal head to be measured comprise the glaze height H, the heater resistance value R of the thermal head and at least one value selected from the group consisting of the glaze width W, the protective film thickness d, the heater width l and the heater length L of the thermal head.

12. A thermal head adjusting method according to claim 10, wherein the glaze width W, the protective film thickness d, the heater width l, the heater length L and the heater resistance value R have reference values represented by $w_0$, $d_0$, $l_0$, $L_0$ and $R_0$, respectively, and have measured initial values represented by $W_i$, $d_i$, $l_i$, $L_i$ and $R_i$, respectively, and wherein the rates of change $\Delta P_W$, $\Delta Pd$, $\Delta P_l$, $\Delta P_L$ of an applied power P, which is required to record a maximum necessary density at the respective initial values $W_i$, $d_i$, $i_i$ and $L_i$, to a reference power $P_0$ are determined from predetermined relationships, respectively, and the applied voltage, V, determined from the following formula (1), is applied to the thermal head:

$$V = \sqrt{\frac{(1+\Delta P_W)(1+\Delta P_d)(1+\Delta P_l)(1+\Delta P_L)R_i}{R_0}} \cdot V_0 \quad (1)$$

wherein $V_0$ is a voltage necessary to apply the reference power $P_0$ to the thermal head.

13. A thermal head adjusting method according to claim 10, further comprising:

adjusting the respective applied voltage according to a change of the protective film thickness d caused by wear of the thermal head.

* * * * *